United States Patent [19]

Antonelli

[11] Patent Number: 4,591,201

[45] Date of Patent: May 27, 1986

[54] DEVICE FOR CARRYING WOOD AND THE LIKE

[76] Inventor: Michael J. Antonelli, 14417 Aiken Rd., Louisville, Ky. 40223

[21] Appl. No.: 677,578

[22] Filed: Dec. 3, 1984

[51] Int. Cl.[4] ..... A45F 3/00

[52] U.S. Cl. ..... 294/137; 294/153

[58] Field of Search ..... 294/137, 144, 152, 172, 294/15, 17, 9, 19 R, 26, 27 R, 27 H, 92, 153

[56] References Cited

U.S. PATENT DOCUMENTS 1,938,478 12/1933 Bailer ..... 294/152

2,848,149 8/1958 Ward ..... 294/152

3,759,430 9/1973 Ward ..... 294/137

*Primary Examiner*—James B. Marbert

*Attorney, Agent, or Firm*—Charles G. Lamb

[57] ABSTRACT

A device for carrying firewood, kindling and the like includes an arcuate body with a hand grasp located at one longitudinal edge for grasping by a hand, and a channel on the convex side of the arcuate body for locating a human arm. In use, the wood carrying device is supported on an arm with the convex side of the arcuate body cradled by the upper arm and forearm with the hand of the arm grasping the hand grasp. The wood to be carried is placed on the concave surface of the arcuate body.

14 Claims, 4 Drawing Figures

DEVICE FOR CARRYING WOOD AND THE LIKE

BACKGROUND OF THE INVENTION

1. Field of the Invention

The present invention relates to carriers for articles such as firewood and the like, and more particularly to a carrier device for wood and the like which is supported by a human arm.

2. Description of the Prior Art

Various wood carriers or totes are known in the art.

For example, U.S. Pat. No. 398,902, issued on Mar. 5, 1889 to E. W. Payne, shows a wood carrier having two wire loops located at an acute angle to each other. A handle is provided at the converging ends of the wire loops. The wood to be carried is inserted through the loops so that it straddles the loops and is, thereby, supported.

Another example of a known wood carrier device is shown in U.S. Pat. No. 705,383, issued on July 22, 1902 to J. G. Cofman, as including a rectangular wire frame having upturned ends and wire handles attached to the upturned frame ends. Wood to be carried is placed transversely on the wire frame to rest on the side wires of the frame.

Yet another type of wood carrier is shown in U.S. Pat. No. 515,353, issued on Feb. 27, 1894 to J. H. McIntosh, which consists of a rectangular box having two spaced apart frame members attached to the box and extending upwardly therefrom. A handle is located over the arched frame members. Wood to be carried is laid across the box between arched frame members.

SUMMARY OF THE INVENTION

The present invention provides a wood carrying device adapted for conveniently carrying an arm load of wood.

The present invention further provides a wood carrying device which can be unobtrusively stored when not being used.

The present invention even further provides a wood carrying device which can be easily cleaned.

More particularly, the present invention provides a device for carrying wood and the like, comprising an arcuate body adapted to receive the wood to be carried on its concave surface; and hand grasp means located at at least one of the longitudinal sides of the arcuate body adapted to be grasped by a human hand.

BRIEF DESCRIPTION OF THE DRAWINGS

The various features and advantages of the present invention will become even more clear upon reference to the following description in conjunction with the accompanying drawings wherein.

DETAILED DESCRIPTION OF THE PREFERRED EMBODIMENT

Figure 1:
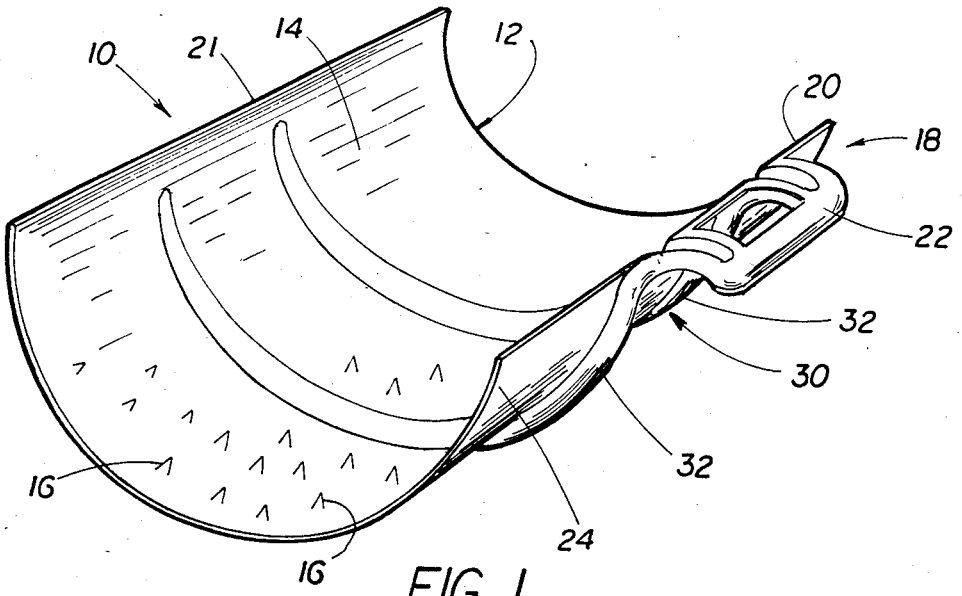
FIG. 1 is a perspective view of the wood carrying device of the invention.
Figure 2:
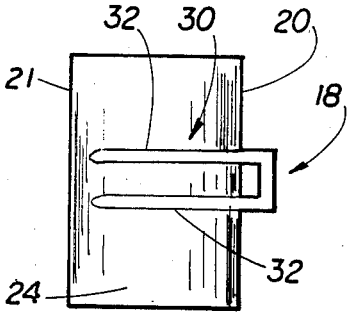
FIG. 2 is a bottom view of the wood carrying device of FIG. 2.

With reference to FIGS. 1 and 2, there is shown a wood carrying device, generally denoted as the numeral 10, of the present invention, which provides for conveniently toting an arm full of wood.

The wood carrying device 10 is shown as including an arcuate body 12. The arcuate shape of the body 12 can be of virtually any geometric development, for example, it may be parabolic, it may have a constantly changing radius, or as shown, it can be semi-cylindrical.

The concave surface 14 of the arcuate body 12 includes means for reducing slippage of wood placed on the concave surface 14. As can be seen in FIG. 1, the slippage reducing means 14 includes a plurality of spaced apart projections 16 arranged over the concave surface 14.

With reference to FIGS. 1 and 2, the wood carrying device 10 also has hand grasp means 18 located at at least one of the longitudinal sides 20 of the arcuate body 12. As shown, the hand grasp means 18 is a handle 22 attached to the longitudinal side 20 of the arcuate body 12 and is centered on the transverse centerline of the arcuate body 12. The handle 22 preferrably projects away from the convex surface 24 of the arcuate body 12, for example, in a generally radial direction. The outward projection of the handle 22 allows one to grasp the handle 22 without having to bend the wrist as can be seen in FIG. 4.

Figure 3:
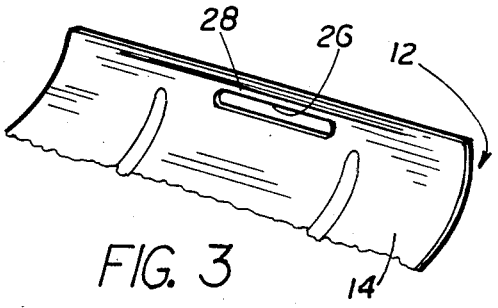
FIG. 3 illustrates an alternative component of the wood carrying device of FIGS. 1 and 2; and, FIG. 4 illustrates the wood carrying device in use for toting firewood.

Alternatively, with reference to FIG. 3, the hand grip means 18 comprises an elongated aperture 26 formed through the arcuate body 12 spaced from the longitudinal side 20 by an appropriate distance providing for the grasping of the material between the aperture 26 and longitudinal side 20 thereby defining a handle 28.

Figure 4:
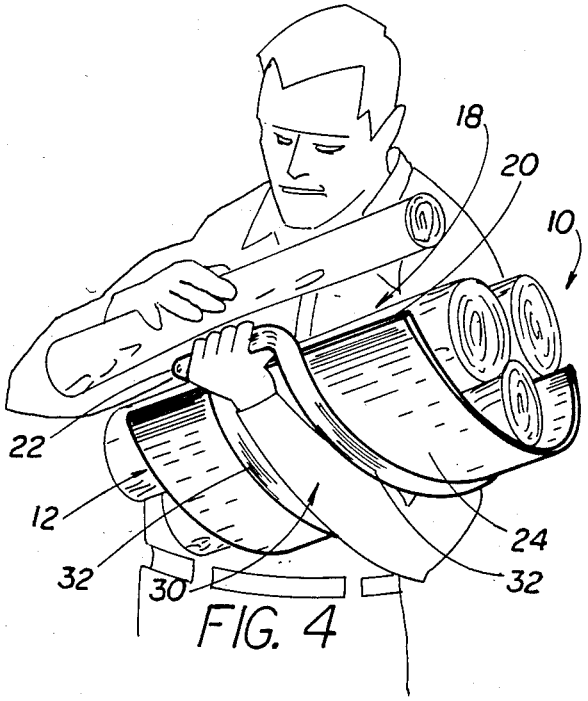

Now with reference to FIGS. 1, 2 and 4, the wood carrying device 10 further includes means, generally denoted as the numeral 30, for locating a human arm on the convex surface 24 of the arcuate body 12. The arm locating means 30 is shown as a pair of parallel, spaced apart ribs 32 located on the convex surface 24. The ribs 32 are spaced apart by a distance sufficient to receive a human arm therebetween. As illustrated, the pair of ribs 32 extend substantially from one longitudinal side 20 to the other longitudinal side 21 of the arcuate body 12 generally transversely to the longitudinal centerline of the arcuate body 12. Preferrably, the pair of ribs 32 is centered on the transverse centerline of the arcuate body 12. Further, as shown in FIGS. 1 and 2, the ribs 32 extend past the one longitudinal side 20 of the arcuate body 12 and serve as a part of the handle 22. The portion of the ribs 32 extending past the one longitudinal side 20 of the arcuate body 12 curve away from the convex surface 24 of the arcuate body 12.

FIG. 4 shows the wood carrier device 10 in use. A person using the device 10 cradles it in one arm with the arm located in the space between the pair of ribs 32 and the hand of that arm grasping the handle 20. The ribs 32 properly locate the arm on the convex surface 34 of the arcuate body 12, and prevents the wood carrying device 10 from sliding off the arm. The person using the carrying device 10 can then easily load wood onto the concave surface 14 of the arcuate body 12. The projections 16 on the concave surface 14 engage the bark or rough surface of the wood to reduce the slippage of the wood in contact with the concave surface 14 thereby reducing the chances of the wood slipping out of the wood loading device 10.

The wood carrying device 10 can be advantageously fabricated of any suitable material, such as aluminum, or other easily bendable, light weight metals, but the preferred materials of construction are plastic materials such as, for example, a plastic made from a molding process so that the handle, pair of ribs, and projections on the concave surface of the arcuate body are all integral with the arcuate body. Therefore, the wood carrying device can be fabricated without the need to assemble separate components. In addition, plastic is strong, dent resistant, rust resistant and easily cleaned.

The foregoing detailed description is given primarily for clearness of understanding and no unnecessary limitations are to be understood therefrom for modifications will become obvious to those skilled in the art upon reading the disclosure and may be made without department from the spirit of the invention and scope of the appended claims.

What is claimed:

1. A device for carrying pieces of firewood and the like, comprising:

an arcuate body adapted to receive wood to be carried on its concave surface;

a single hand grasp located at one of the longitudinal sides of the arcuate body and integral with said arcuate body adapted to be grasped by a human hand; and, a pair of parallel, spaced apart integral ribs located on the convex surface of the arcuate body for locating a human arm on the convex surface of the arcuate body.

2. The device of claim 1, wherein the pair of ribs extend substantially from one longitudinal edge to the other longitudinal edge of the arcuate body.

3. The device of claim 2, wherein the pair of ribs extend generally transverse to the longitudinal axis of the arcuate body.

4. The device of claim 3, wherein the pair of ribs are centered on the transverse centerline of the arcuate body.

5. The device of claim 4, wherein the space between the ribs is in alignment with the hand grasp means.

6. The device of claim 5, wherein the ribs are integral with the arcuate body.

7. The device of claim 1, wherein the hand grasp means comprises a handle device.

8. The device of claim 7, wherein the handle device is centered on the transverse centerline of the arcuate body.

9. The device of claim 1, wherein the hand grasp means projects away from the convex surface of the arcuate body.

10. The device of claim 9, wherein the hand grasp means projects in a generally radial direction of the arcuate body.

11. The device of claim 1, wherein the hand grasp means comprises an aperture formed through the arcuate body spaced from the one longitudinal side of the arcuate body, wherein the material of the arcuate body between the aperture and one longitudinal side defines a handle.

12. The device of claim 1, further comprising means located on the concave surface of the arcuate body for preventing the pieces of wood in contact with the concave surface from slipping.

13. The device of claim 12, wherein the slip preventing means comprises a plurality of projections on the concave surface of the arcuate body.

14. The device of claim 1, wherein the semi-cylindrical body is fabricated of a plastic.

* * * * *